US011091970B2

(12) United States Patent
Hawkins, III

(10) Patent No.: US 11,091,970 B2
(45) Date of Patent: Aug. 17, 2021

(54) MECHANICAL ISOLATION DEVICE, SYSTEMS AND METHODS FOR CONTROLLING FLUID FLOW INSIDE A TUBULAR IN A WELLBORE

(71) Applicant: Drilling Innovative Solutions, LLC, Lafayette, LA (US)

(72) Inventor: Samuel P. Hawkins, III, Scott, LA (US)

(73) Assignee: Drilling Innovative Solutions, LLC, Lafayette, LA (US)

( * ) Notice: Subject to any disclaimer, the term of this patent is extended or adjusted under 35 U.S.C. 154(b) by 7 days.

(21) Appl. No.: 16/624,521

(22) PCT Filed: Jun. 21, 2018

(86) PCT No.: PCT/US2018/038848

§ 371 (c)(1),
(2) Date: Dec. 19, 2019

(87) PCT Pub. No.: WO2018/237203

PCT Pub. Date: Dec. 27, 2018

(65) Prior Publication Data

US 2020/0256141 A1 Aug. 13, 2020

Related U.S. Application Data

(60) Provisional application No. 62/523,117, filed on Jun. 21, 2017.

(51) Int. Cl.
*E21B 34/14* (2006.01)
*E21B 34/12* (2006.01)
(Continued)

(52) U.S. Cl.
CPC ..... *E21B 23/03* (2013.01); *E21B 21/10* (2013.01); *E21B 34/105* (2013.01); *E21B 34/14* (2013.01);
(Continued)

(58) Field of Classification Search
CPC ..... E21B 34/12; E21B 34/14; E21B 33/13
See application file for complete search history.

(56) References Cited

U.S. PATENT DOCUMENTS 3,768,562 A * 10/1973 Baker ..... E21B 33/146 166/289
4,407,369 A 10/1983 Hutchison et al.
(Continued)

OTHER PUBLICATIONS

International Search Report and Written Opinion of the International Searching Authority issued by the United States Patent & Trademark Office dated Oct. 29, 2018 in International Patent Application No. PCT/US2018/038848.
(Continued)

*Primary Examiner* — Kenneth L Thompson
(74) *Attorney, Agent, or Firm* — Matthews, Lawson, McCutcheon & Joseph, PLLC

(57) ABSTRACT

Systems and methods include a mechanical isolation device that comprises a sleeve, which includes a port for fluid flow between an internal bore of the sleeve and an inside of a tubular. A receiver positioned in the internal bore includes a first orifice at a first axial location on the receiver, and a second orifice at a second axial location on the receiver. The second orifice is either aligned or un-aligned with the port of the sleeve. The receiver is slidable within the sleeve to: (i) move the first orifice into alignment with the port and either move the second orifice out of alignment with the port or keep the second orifice out of alignment with the port; and (ii) move the first orifice out of alignment with the port so that a portion of the receiver covers the port to block fluid flow between the internal bore of the sleeve and the port.

20 Claims, 10 Drawing Sheets

(51) Int. Cl.

| | |
|---|---|
| ***E21B 33/13*** | (2006.01) |
| ***E21B 23/03*** | (2006.01) |
| ***E21B 34/10*** | (2006.01) |
| ***E21B 21/10*** | (2006.01) |
| *E21B 21/08* | (2006.01) |
| *E21B 33/16* | (2006.01) |

(52) U.S. Cl.
CPC ..... *E21B 21/08* (2013.01); *E21B 33/16* (2013.01); *E21B 2200/04* (2020.05); *E21B 2200/05* (2020.05)

(56) References Cited

U.S. PATENT DOCUMENTS

| | | | | |
|---|---|---|---|---|
| 5,156,220 | A * | 10/1992 | Forehand | E21B 34/14 166/386 |
| 5,305,833 | A | 4/1994 | Collins | |
| 5,497,807 | A * | 3/1996 | Rogers | F16L 55/1645 138/98 |
| 7,971,646 | B2 * | 7/2011 | Murray | E21B 43/02 166/332.4 |
| 9,574,421 | B1 * | 2/2017 | Saraya | E21B 34/142 |
| 2002/0088621 | A1 | 7/2002 | Hamilton et al. | |
| 2003/0019630 | A1 * | 1/2003 | Freiheit | E21B 34/14 166/332.4 |
| 2008/0217038 | A1 | 9/2008 | Crooks | |
| 2012/0312547 | A1 | 12/2012 | Miller | |
| 2014/0083708 | A1 | 3/2014 | Beck et al. | |
| 2015/0096807 | A1 | 4/2015 | Strilchuk | |
| 2016/0123114 | A1 | 5/2016 | Flores | |

OTHER PUBLICATIONS

International Preliminary Report on Patentability issued by the United States Patent & Trademark Office on May 17, 2019 in International Patent Application No. PCT/US2018/038848.

* cited by examiner

MECHANICAL ISOLATION DEVICE, SYSTEMS AND METHODS FOR CONTROLLING FLUID FLOW INSIDE A TUBULAR IN A WELLBORE

CROSS REFERENCE TO RELATED APPLICATIONS

This application claims priority to International Patent Application No. PCT PCT/US2018/038848, entitled "Mechanical Isolation Device, Systems and Method for Controlling Fluid Flow Inside a Tubular in a Wellbore", filed on Jun. 21, 2018, which claims priority to U.S. Provisional Application No. 62/523,117, entitled "Float Valve Systems", filed on Jun. 21, 2017. The disclosures of the prior applications are hereby incorporated by reference herein in their entireties.

FIELD

The present disclosure relates, generally, to a mechanical isolation device, systems and methods for controlling fluid flow inside a tubular in a wellbore. More particularly, the disclosure relates to a mechanical isolation device, systems and methods that include mounting a stabbing tool on an inner string, and inserting a stabbing tool onto a mechanical isolation device positioned inside of a tubular, to engage the mechanical isolation device and move a part of the mechanical isolation device in different directions. Movement of the part of the mechanical isolation device via the stabbing tool selectively closes and opens flow paths within the mechanical isolation device.

BACKGROUND

The oil and gas industry has utilized one-way float valves for a variety of applications, including oil and gas wellbore operations. One such application is the use of float shoes and float collars, which are designed to prevent backflow of cement slurry into the annulus of a casing or other tubular string, and thereby enable the casing to "float" in the wellbore. Typically, these float shoes and float collars are attached to the end of a casing string and lowered into the wellbore during casing operations. However, this renders the float equipment vulnerable to a variety of problems, such as obstruction or deformation due to debris which is introduced to the float valve during circulation of mud or other drilling fluids. Additionally, unforeseen complications in downhole conditions may render other float equipment with, e.g., higher-strength materials or different designs more suited to cementing operations after the fact.

Further, conventional oil well cementing jobs involve pumping cement down the entire casing string, out through the bottom of the casing string to fill the annulus adjacent the outer surface of the casing string. This cementing technique results in the need, once the cement has been pumped, for cleaning the inside of the casing string. Such a cleaning step requires an additional trip down the string with a cleaning tool. In addition, conventional cementing jobs require the use of a cement retainer or breech plug for sealing the casing and/or for performing negative testing on the casing. Placing such equipment downhole after the cementing and cleaning requires yet another trip down the casing string. Once the retainer or breech plug is in place, a pressure test device is sent through the casing string in a further trip. Additional steps, requiring even more trips down the casing string, include drilling out the cement retainer or breech plug, and then a second cleaning step of removing debris from the drilled out retainer or plug inside of the casing string.

There is thus a need for a mechanical isolation device that can be positioned within the casing string before the casing string is lowered into the wellbore, and that can be manipulated with a single subsequent trip of an inner-string tool down the casing string to close and open flow paths within the mechanical isolation device.

Embodiments of the system, disclosed herein, achieve this need.

SUMMARY

The present disclosure includes embodiments directed to a mechanical isolation device, systems and methods for controlling fluid flow inside a tubular in a wellbore suitable for use in subterranean drilling. The mechanical isolation device, systems and methods provide an alternative to existing cement retainer equipment and processes by simplifying wellbore running procedures, increasing reliability of the barrier function, and reducing overall costs (e.g., by reducing the number of trips down the wellbore) of the well cementing process.

In embodiments of the present disclosure, the mechanical isolation device may assume three functional positions. The first position may be an "auto-fill" position (see FIGS. 1 and 2) that allows well fluid to fill the casing string when the casing string is being moved (run) within the wellbore. The "auto-fill" position may be a one-time position only of the mechanical isolation device, and is the position before a stabbing tool is inserted into the wellbore. The second position is a "pumping" position (see FIGS. 4 and 5) in which the fluid flow that was permitted in the first position is blocked to allow, for instance, cement to be pumped into the casing string and out through a bottom of the casing string. The third position is a "closed" position (see FIGS. 6-8), in which the fluid flow and the pumping path in the first and second positions, respectively, are closed. While the "auto-fill" position may be a one-time position, the mechanical isolation device can be switched multiple times between the "pumping" position and the "closed" position.

An embodiment of the present invention includes a system for controlling fluid flow inside a tubular in a wellbore that comprises a tubular, a sleeve positioned within the tubular, wherein the sleeve includes an internal bore and at least one port for fluid flow between the internal bore of the sleeve and an inside of the tubular, and a receiver positioned in the internal bore of the sleeve, so that the tubular, the sleeve and the receiver form a unit for insertion into the wellbore. The receiver can include a first orifice and a second orifice for fluid flow between the internal bore of the sleeve and the at least one port of the sleeve, wherein the first orifice can be unaligned with the at least one port of the sleeve and the second orifice is either aligned or unaligned with the at least one port of the sleeve. The system can further include a tool for lowering into the wellbore and the tubular, and (i) moving the receiver in a first direction to move the first orifice into alignment with the at least one port of the sleeve and move the second orifice out of alignment with the at least one port of the sleeve or keep the second orifice out of alignment with the at least one port of the sleeve, and (ii) moving the receiver in a second direction to move the first orifice out of alignment with the at least one port of the sleeve so that a portion of the receiver covers the at least one port of the sleeve.

In an embodiment, the alignment of the first orifice with the at least one port of the sleeve opens a fluid flow path between the internal bore of the sleeve, the first orifice, the at least one port of the sleeve, and the inside of the tubular, and the portion of the receiver covering the at least one port blocks fluid flow between the internal bore of the sleeve and the at least one port of the sleeve. In an embodiment, the first orifice can include a set of two or more orifices located around a circumference of the receiver at a first axial location on the receiver, wherein the sleeve can comprise two or more ports, and wherein each of the two or more orifices can move into alignment with one of the two or more ports via movement of the receiver in the first direction.

In an embodiment, the tool includes a distal end, and the receiver includes an attaching portion that releasably engages the distal end of the tool when the tool is moved in the first direction onto to the receiver, and the tool moves the receiver in the second direction via the attaching portion.

In an embodiment, an inner diameter of the sleeve varies along a length of the sleeve in an area adjacent the attaching portion, so that movement of the attaching portion along the area increases or decreases an outer diameter of the attaching portion.

In an embodiment, a decrease in the outer diameter of the attaching portion causes the attaching portion to engage the distal end of the tool, and an increase in the outer diameter of the attaching portion causes the attaching portion to disengage the distal end of the tool.

In an embodiment, the attaching portion includes at least one locking finger that engages with a recess on an inner surface of the sleeve to position the receiver at a predetermined location inside of the sleeve.

In an embodiment, the sleeve includes a first no-go shoulder that engages with a portion of the receiver to prevent further movement of the receiver in the second direction when the first orifice is out of alignment with the at least one port of the sleeve.

In an embodiment, the sleeve includes a second no-go shoulder that engages with a portion of the tool to prevent further movement of the tool in the first direction after the first orifice is moved into alignment with the at least one port of the sleeve.

In an embodiment, a longitudinal length of the receiver extends from one end of the receiver to an opposite end of the receiver, the first orifice is at a first axial location on the longitudinal length, and the second orifice is provided at a second axial location on the longitudinal length.

In an embodiment, the second orifice is aligned with the at least one port of the sleeve before the tool moves the receiver in the first direction to move the first orifice into alignment with the at least one port of the sleeve, and the alignment of the second orifice with the at least one port forms a fluid flow path between the internal bore of the sleeve, the second orifice, the at least one port of the sleeve, and the inside of the tubular.

In an embodiment of the present invention, a mechanical isolation device for controlling fluid flow inside a tubular in a wellbore can comprise: a sleeve including an internal bore and at least one port for fluid flow between the internal bore of the sleeve and an inside of the tubular, and a receiver positioned in the internal bore of the sleeve, wherein the receiver includes an attaching portion at one end of the receiver. The mechanical isolation device can further include a first orifice at a first axial location on a longitudinal length of the receiver, and a second orifice at a second axial location on the longitudinal length, wherein the second orifice is either aligned or un-aligned with the at least one port of the sleeve, and the receiver can be slidable within the sleeve to: (i) move the first orifice into alignment with the at least one port of the sleeve and either move the second orifice out of alignment with the at least one port of the sleeve or keep the second orifice out of alignment with the at least one port of the sleeve, for fluid flow between the internal bore of the sleeve, the first orifice, and the at least one port of the sleeve; and (ii) move the first orifice out of alignment with the at least one port of the sleeve so that a portion of the receiver covers the at least one port of the sleeve to block fluid flow between the internal bore of the sleeve and the at least one port of the sleeve.

In an embodiment, the sleeve includes a first no-go shoulder that engages with a portion of the receiver to prevent movement of the receiver beyond the no-go shoulder.

In an embodiment, an inner diameter of the sleeve can vary along a length of the sleeve in an area adjacent the attaching portion, so that movement of the attaching portion along the area increases or decreases an outer diameter of the attaching portion.

In an embodiment, the attaching portion can be configured to engage and disengage a distal end of a tool. A decrease in the outer diameter of the attaching portion can cause the attaching portion to engage the distal end of the tool, and an increase in the outer diameter of the attaching portion can cause the attaching portion to disengage the distal end of the tool. In an embodiment, the attaching portion can include at least one locking finger that can engage with a recess on an inner surface of the sleeve when the receiver is in a position, such that the portion of the receiver covers the at least one port of the sleeve.

In an embodiment, the first orifice can include a set of two or more first orifices located around a circumference of the receiver at the first axial location, wherein the second orifice can be a set of two or more second orifices located around a circumference of the receiver at the second axial location, wherein the sleeve can comprise two or more ports around a circumference of the sleeve at an axial location on the sleeve, and wherein each of the two or more ports can be alignable with one of the two or more first orifices and can be alignable with one of the two or more second orifices.

An embodiment of the present invention can include a method of controlling fluid flow inside a tubular in a wellbore. The steps of the method can comprise: positioning a receiver within an internal bore of a sleeve so that a first orifice of the receiver is either aligned or un-aligned with a port of the sleeve, inserting the sleeve inside of the tubular, installing the tubular, including the sleeve and the receiver, in the wellbore, and inserting a tool into the tubular and onto the receiver to move the receiver with a force. The force can be used to move the receiver relative to the sleeve to align a second orifice of the receiver with the port of the sleeve and either un-align or keep un-aligned the first orifice of the receiver from the port of the sleeve.

In an embodiment, the method further comprises moving the tool in a direction out of the tubular to move the receiver with another force that un-aligns the second orifice of the receiver from the port of the sleeve. In an embodiment, un-aligning the second orifice of the receiver from the port of the sleeve aligns a portion of the receiver with the port of the sleeve to close the port.

In an embodiment, the method further comprises pumping cement into the internal bore of the sleeve and through the second orifice, the at least one port of the sleeve, and the inside of the tubular.

The foregoing is intended to give a general idea of the embodiments, and is not intended to fully define nor limit the invention. The embodiments will be more fully understood and better appreciated by reference to the following description and drawings.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
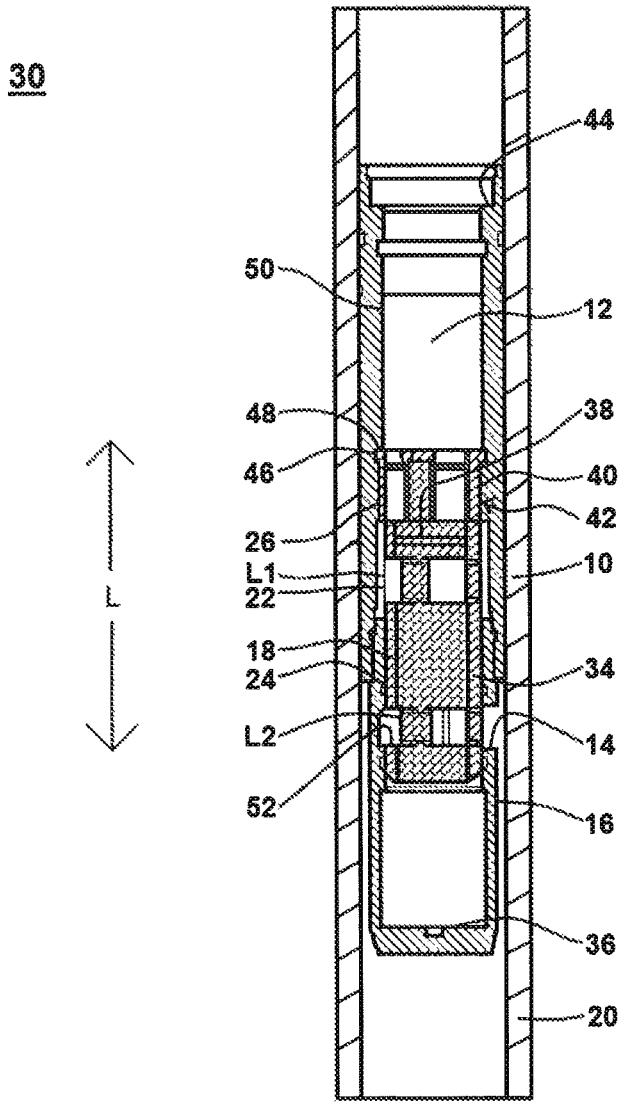
FIG. 1 illustrates a mechanical isolation device according to an embodiment.
Figure 2:
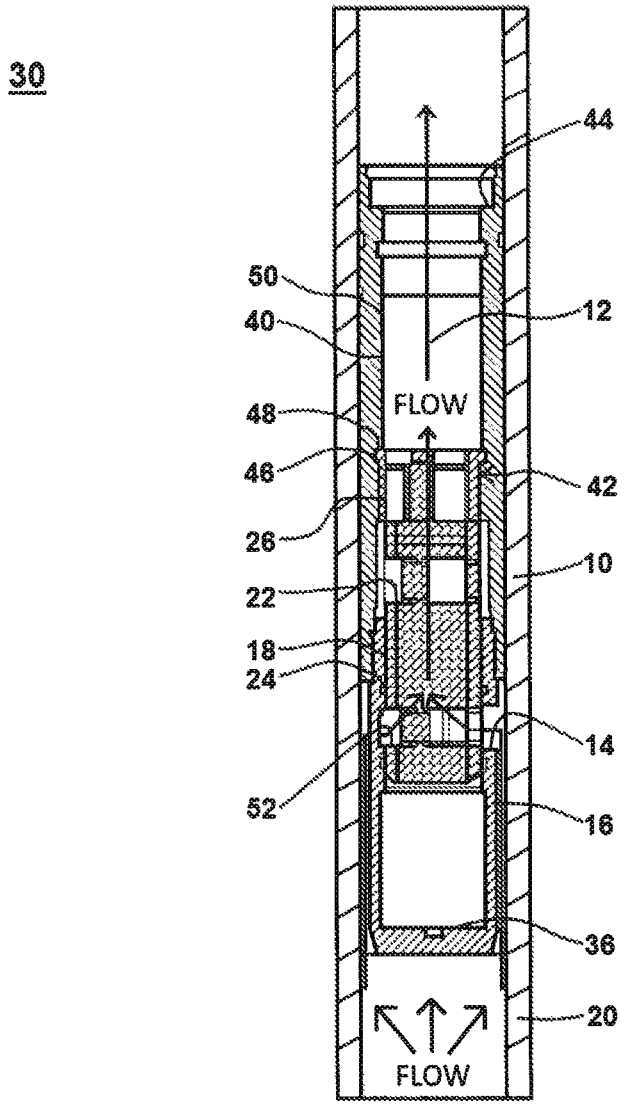
FIG. 2 illustrates fluid flow through the mechanical isolation device in the "auto-fill" position according to an embodiment.

FIG. 1 illustrates an embodiment of a mechanical isolation device. The figure shows a sleeve 10 located inside of a tubular 20 that is to be inserted into a wellbore 30. The tubular 20 may include connectors at opposing ends for connection to another tubular (not shown). The connectors may be threads on an inner or outer surface of the tubular 20. The sleeve 10 may be installed in the tubular 20 at the surface and run in with the tubular 20 or casing/liner, thus eliminating the additional step of mechanically setting a packer or bridge plug retainer. The sleeve 10 includes an internal bore 12, and a port 14 at an outer surface 16 of the sleeve 10. The sleeve 10 may comprise a single port 14, or a series of ports 14 around a circumference of the sleeve 10, as shown in FIG. 1. The port 14, or series of ports 14, is for fluid flow between the internal bore 12 of the sleeve 10 and an inside of the tubular 20, as shown with arrows in FIG. 2. The length of the sleeve 10 is not limited to a particular length, but in one embodiment is 48 inches. In some embodiments, the sleeve 10 may have a pressure rating of up to 10,000 psi, and may have a temperature rating of 450 degrees Fahrenheit.

A receiver 18 is positioned in the internal bore 12 of the sleeve 10. Thus, the sleeve 10, when run in with the tubular 20 or casing/liner, includes the receiver 18 positioned therein. That is, the tubular 20 having the sleeve 10 and the receiver 18 form a unit at the surface before the tubular 20 (and accompanying sleeve 10 and receiver 18) are inserted into the wellbore 30. As discussed in detail below, the receiver 18 is slidable within the sleeve 10 so as to move relative to the sleeve 10. The receiver 18 has a longitudinal length "L" that extends from one end of the receiver 18 to an opposite end of the receiver 18. A first orifice 22 is located at a first location L1 on an outer surface 24 of the receiver 18 on the longitudinal length "L". The receiver 18 may have only one first orifice 22, or may have a series of first orifices 22 around a circumference of the receiver 18 at the first location L1 on the longitudinal length "L", as shown in FIG. 1. The first orifice 22 aligned with the at least one port 14 of the sleeve 10 provides a fluid flow path into the internal bore 12 of the sleeve 10. A second orifice 52 is provided at a second location L2 on the longitudinal length "L" of the receiver 18. A portion, or wall, 34 of the receiver 18 extends between the first orifice 22 and the second orifice 52. The receiver 18 may have only one second orifice 52, or may have a series of second orifices 52 around the circumference of the receiver 18 at the second location L2 on the longitudinal length "L". The end of the receiver 18 closest to the first orifice 22 comprises an attaching portion 26 that releasably engages the distal end 32 of a tool 28, such as a stabbing tool or stinger (see FIG. 3), as discussed in detail below. The sleeve 10 is open at one end thereof to receive the stabbing tool 28 through the opening (as shown in FIG. 4), and is closed at an opposite end via a bottom wall 36. The material of the sleeve 10 and the receiver 18 may be formed of a type that is drillable upon completion of a cementing operation, in case completion of the wellbore 30 requires a depth greater than the location of the sleeve 10. In one embodiment, the material is aluminum.

FIG. 1 shows the "auto-fill" position of the mechanical isolation device. The "auto-fill" may be the position of the mechanical isolation device before insertion of the stabbing tool 28 (discussed below) into the tubular 20. In the "auto-fill" position, the receiver 18 is positioned within the sleeve 10 so that the second orifice (or second orifices) 52 is aligned with the port (or ports) 14 of the sleeve 10. The sleeve 10 and accompanying receiver 18 may be run in with the tubular 20 or casing/liner the "auto-fill" position. The alignment of the second orifice (or second orifices) 52 with the port (or ports) 14 allows well fluid, such as hydrocarbons, to flow between the internal bore 12 of the sleeve 10, the second orifice (or second orifices) 52 of the receiver 18, the port (or ports) 14 of the sleeve 10, and the inside of the tubular 20. An embodiment of the fluid flow path is indicated by the arrows in FIG. 2.

In another embodiment, instead of the "auto-fill" position, the receiver 18 may positioned within the sleeve 10 with the second orifice (or second orifices) 52 out of alignment with the port (or ports) 14 of the sleeve 10. In that embodiment, the sleeve 10 and accompanying receiver 18 are run in with the tubular 20 or casing/liner with both the first orifice (or first orifices) 22 and the second orifice (or second orifices) 52 out of alignment with the port (or ports) 14. In such an embodiment, the position of the receiver 18 relative to the sleeve 10 would different than what is illustrated in FIG. 1, in that the second orifice (or second orifices) 52 would be lower than the port (or ports) 14 so that the portion, or wall, 34 of the receiver 18 covers the port (or ports) 14.

In the "auto-fill" position, at least one locking finger 46 of the receiver 18 engages with a recess 48 on an inner surface 50 of the sleeve 10, to hold the receiver 18 in place. A first no-go shoulder 38 is provided on a portion of the receiver 18. The first no-go shoulder 38 is designed to engage with the distal end 32 of the stabbing tool 28 to provide a contact surface for the stabbing tool 28 to push against the receiver 18, and to prevent movement of the stabbing tool 28 beyond the first no-go shoulder 38 of the receiver 18. In addition, the sleeve 10 may include a second no-go shoulder 44 that is configured to engage with a portion of the stabbing tool 28 to prevent further movement of the stabbing tool 28 beyond the second no-go shoulder 44, as shown in FIG. 4 and discussed in further detail below. An inner diameter 40 of the sleeve 10 varies along a length of the sleeve 10 in an area adjacent the attaching portion 26 of the receiver 18, such that the inner diameter 40 is larger in the area near an upper part of the attaching portion 26 in the "auto-fill" position of the receiver 18, and is smaller in the area near a lower part of the attaching portion 26 in the "auto-fill" position of the receiver 18. The attaching portion 26 has an outer diameter 42 that is variable, as discussed below.

Figure 3:
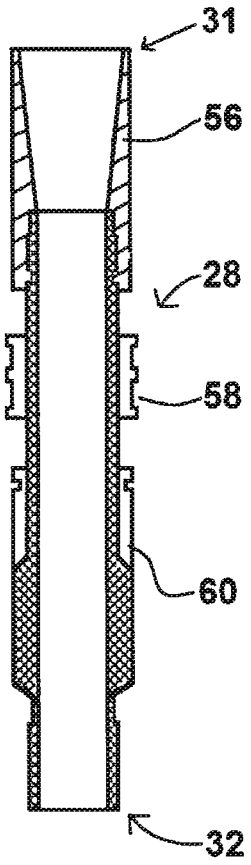
FIG. 3 illustrates a stabbing tool of the mechanical isolation device according to an embodiment.
Figure 4:
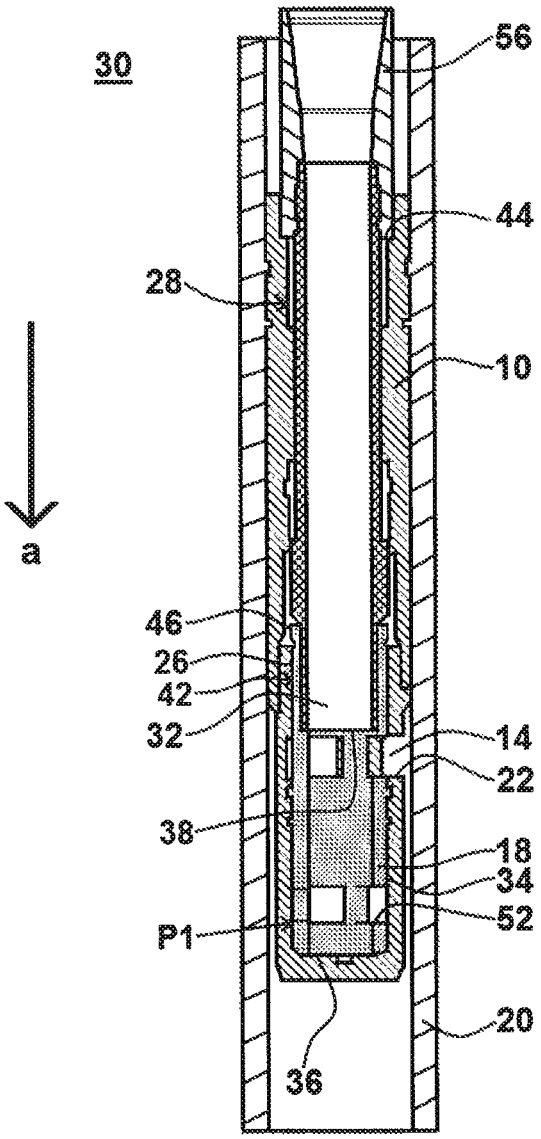
FIG. 4 illustrates a system in which the stabbing tool presses the receiver to a first position according to an embodiment.

FIG. 3 shows an embodiment of the tool 28, which may be a stabbing tool or stinger. The stabbing tool 28 includes a proximal end 31 including a box connection 56, and a distal end 32 opposite the proximal end 31. The box connection 56 may be an NC-38 Connector, but the box connection is not limited to that particular type. The length of the stabbing tool 28 is not limited to a particular length, but in one embodiment may be 40 inches. In one embodiment, the stabbing tool 28 may have an inside diameter of approximately 2.8 inches and an outside diameter of approximately 3.69 inches to 4.25 inches. The internal diameter may allow for greater flow volume during cementing operations then in conventional processes. In addition, the outside diameter of the stabbing tool 28 may vary along the length of the stabbing tool 28 from 3.69 inches to 4.25 inches, so as to have one or more protrusions and/or one or more recesses along the length of the stabbing tool 28. The stabbing tool 28 may include one or more seals, such as an isolating seal 58, which seals against flow between a collar housing and the receiver 18. The stabbing tool 28 may also include an operating seal 60, which seals against flow between the outer surface of the stabbing tool 28 and the inner surface 50 of the sleeve 10. In an embodiment, the stabbing tool 28 includes a locator collar (not shown) to prevent premature unlatching from the mechanical isolation device. The stabbing tool 28 may further include one or more brushes (not shown) for cleaning the interior of the tubing string and/or stabilizing the inner-string on which the stabbing tool 28 is attached. The stabbing tool 28 can be recertified and utilized on several cementing operations.

Once the casing string, including the tubular 20 having the mechanical isolation device (i.e., the receiver 18 positioned inside the sleeve 10), is positioned in the wellbore 30, the stabbing tool 28 can be attached to an inner-string (not shown) that is run into the casing string during liner installation. The stabbing tool 28 is configured to be lowered into the tubular 20 on the inner-string via pipe reciprocation to selectively actuate a material flow (e.g., a cement pumping operation) and a fluid/material barrier within the tubular 20. In particular, the stabbing tool 28 is configured to be inserted into the tubular 20 to be introduced into the sleeve 10. As shown in the system illustrated in FIG. 4, movement of the stabbing tool 28 into the sleeve 10 along a first direction "a" causes the distal end 32 of the stabbing tool 28 to releasably engage with the attaching portion 26 of the receiver 18 and to press against the receiver 18 at the first no-go shoulder 38. The mechanism for releasably attaching the distal end 32 of the stabbing tool 28 to the attaching portion 26 is not particularly limited. In a preferred embodiment, the inner diameter 40 of the sleeve 10 varies along a length of the sleeve 10 in the area adjacent the attaching portion 26 of the receiver 18, as discussed above. In this configuration, the inner diameter 40 of the sleeve 10 is larger in the area near an upper part of the attaching portion 26 in the "auto-fill" position of the receiver 18, and the inner diameter 40 is smaller in the area near a lower part of the attaching portion 26 in the "auto-fill" position of the receiver 18. With this configuration, when the distal end 32 of the stabbing tool 28 releasably engages with the attaching portion 26 and the stabling tool 28 presses against the receiver 18 in the first direction "a", the receiver 18 moves along a length of the sleeve 10 in the first direction "a". During such movement of the receiver 18, the attaching portion 26 slides against the smaller inner diameter 40 of the sleeve 10 so that an outer diameter 42 the attaching portion 26 is reduced. The reduced outer diameter 42 of the attaching portion 26 closes on the distal end 32 of the stabbing tool 28 to grip or latch onto the distal end 32. In this regard, an inner part of the attaching portion 26 may have protrusions that fit into corresponding recesses on an outer surface of the distal end 32 of the stabbing tool 28.

Figure 5:
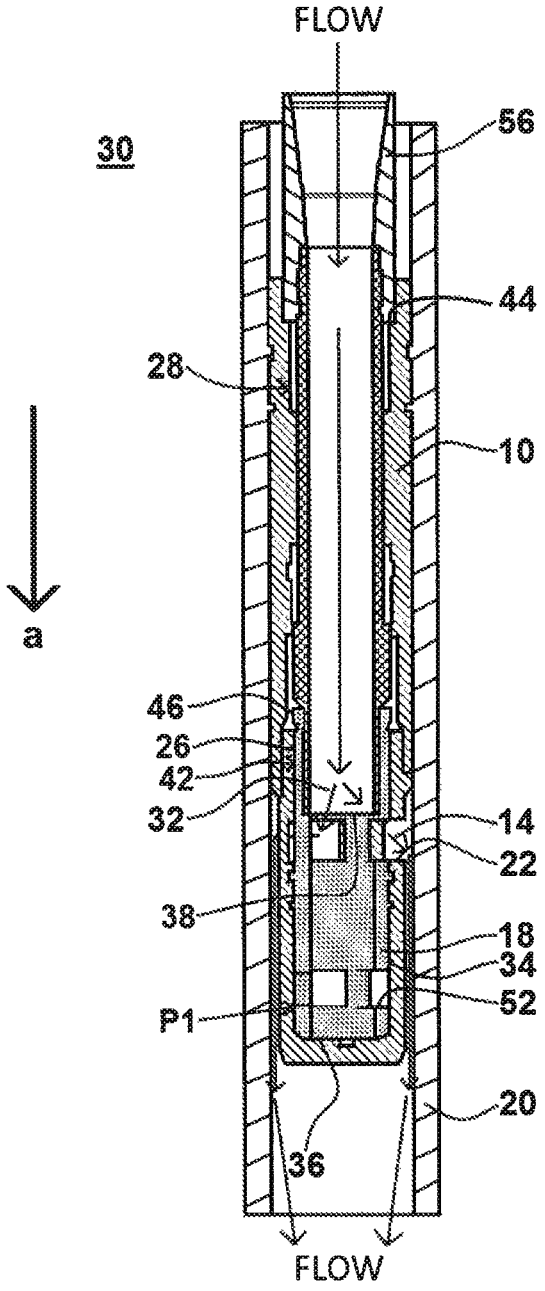
FIG. 5 illustrates cement flow through the mechanical isolation device in the "pumping" position according to an embodiment.

The force of the distal end 32 on the receiver 18 pushes the receiver 18 in the first direction "a" so that the second orifice (or second orifices) 52 comes out of aligned with the port (or ports) 14 of the sleeve 10. The un-alignment of the second orifice (or second orifices) 52 with the port (or ports) 14 closes the fluid flow path between the internal bore 12 of the sleeve 10, the second orifice (or second orifices) 52 of the receiver 18, the port (or ports) 14 of the sleeve 10, and the inside of the tubular 20. This movement of the receiver 18 takes the mechanical isolation device out of the "auto-fill" position shown in FIGS. 1 and 2. If the mechanical isolation device is run in with the tubular 20 or casing/liner while the second orifice (or second orifices) 52 of the receiver 18 are out of alignment with the port (or ports) 14 of the sleeve 10, as in the alternative embodiment, the force of the distal end 32 on the receiver 18 simply keeps the second orifice (or second orifices) 52 out of alignment with the port (or ports) 14 by moving the second orifice (or second orifices) 52 farther away (e.g., in the first direction "a") from the port (or ports) 14. Movement of the receiver 18 in the first direction "a" via the force of the distal end 32 moves the receiver 18 to a first position P1 with respect to the sleeve 10 at which the first orifice (or first orifices) 22 comes into alignment with the at least one port (or ports) 14 of the sleeve 10, as shown in FIG. 4. The alignment of the first orifice (or first orifices) 22 with the at least one port (or ports) 14 creates the "pumping" position of the mechanical isolation device which opens a path that allows fluid or material flow, such as cement, between the internal bore 12 of the sleeve 10, the first orifice (or first orifices) 22, the at least one port (or ports) 14 of the sleeve 10, and the inside of the tubular 20. An embodiment of the fluid or material flow is indicated by the arrows in FIG. 5. The first position P1 of the receiver 18 thus corresponds to the "pumping" position of the mechanical isolation device.

In the "pumping" position (i.e., the first position P1 of the receiver 18), the receiver 18 may abut against the bottom wall 36 of the sleeve 10 to prevent further movement of the stabbing tool 28 in the first direction "a". In addition, a portion of the stabbing tool 28, for example, the box connection 56, may engage with the no-go shoulder 44 of the sleeve 10 in the first position P1 to prevent further movement of the stabbing tool 28 in the first direction "a".

Figure 6:
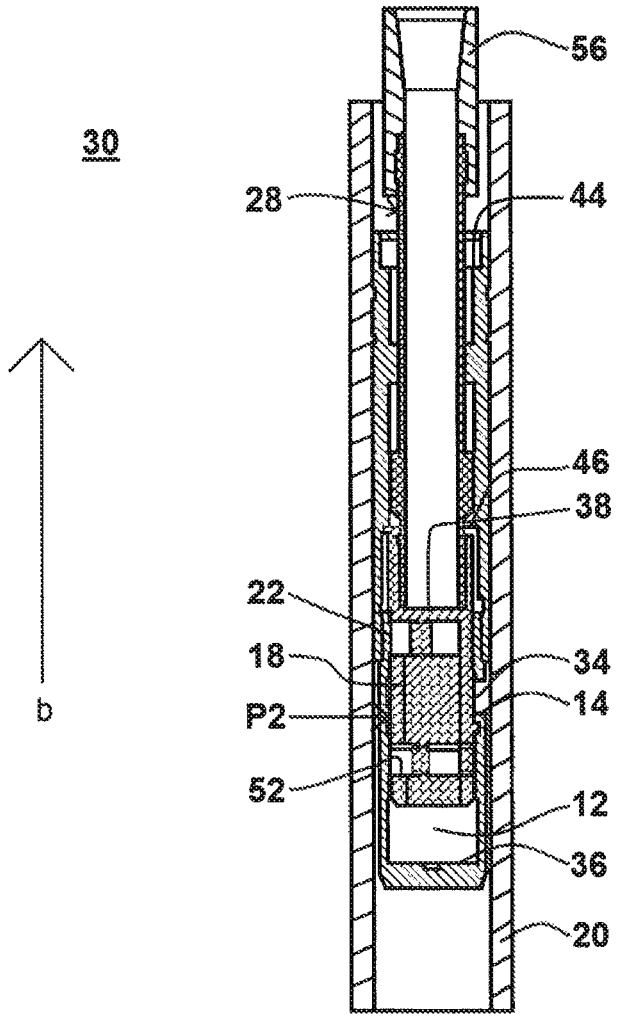
FIG. 6 illustrates the stabbing tool pulling the receiver to a location that places the mechanical isolation device in the "closed" position according to an embodiment.

Once the pumping procedure is completed, the mechanical isolation device may be moved from the "pumping" position to the "closed" position, which is illustrated in FIG. 6. To obtain the "closed" position, the stabbing tool 28 is pulled in a second direction "b" that is opposite to the first direction "a". Because in the "pumping" position the distal end 32 of the stabbing tool is engaged with the attaching portion 26 of the receiver 18, pulling the stabbing tool 28 in the second direction "b" also pulls the receiver 18 in the second direction "b" to a second position P2 at which the first orifice (or first orifices) 22 is out of alignment with the at least one port (or ports) 14 of the sleeve 10. In the second position P2, the wall 34 of the receiver 18 covers the port (or ports) 14 of the sleeve 10 as shown in FIG. 6 to block flow between the internal bore 12 of the sleeve 10 and the at least one port (or ports) 14 of the sleeve 10. In the "closed" position, fluid is prohibited from flowing into the internal bore 12 of the sleeve 10, and cement is prohibited from flowing out through the port (or ports) 14 and into the internal bore of the tubular 20.

Figure 7:
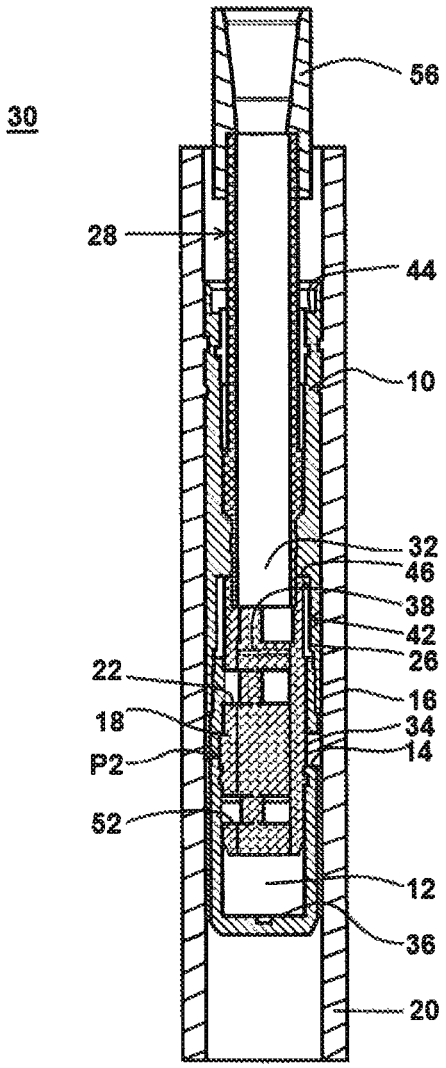
FIGS. 7 and 8 illustrate the stabbing tool being withdrawn from the mechanical isolation device according to an embodiment.

Further movement of the stabbing tool 28 in the second direction "b" disengages the attaching portion 26 from the distal end 32 of the stabbing tool, as the attaching portion 26 slides in the second direction "b" against the inner surface 50 of the sleeve 10 progressively from the smaller inner diameter 40 of the sleeve 10 to the larger inner diameter 40. As discussed above, movement of the attaching portion 26 against the smaller inner diameter 40 of the sleeve 10 to the larger inner diameter 40 increases an outer diameter 42 of the attaching portion 26 so that the attaching portion 26 disengages the distal end 32 of the stabbing tool 28. In one embodiment for example, the protrusions on the inner part of the attaching portion 26 may be withdrawn from corresponding recesses on an outer surface of the distal end 32 of the stabbing tool 28 to release the attaching portion 26 from the distal end 32, as shown in FIG. 7.

Figure 8:
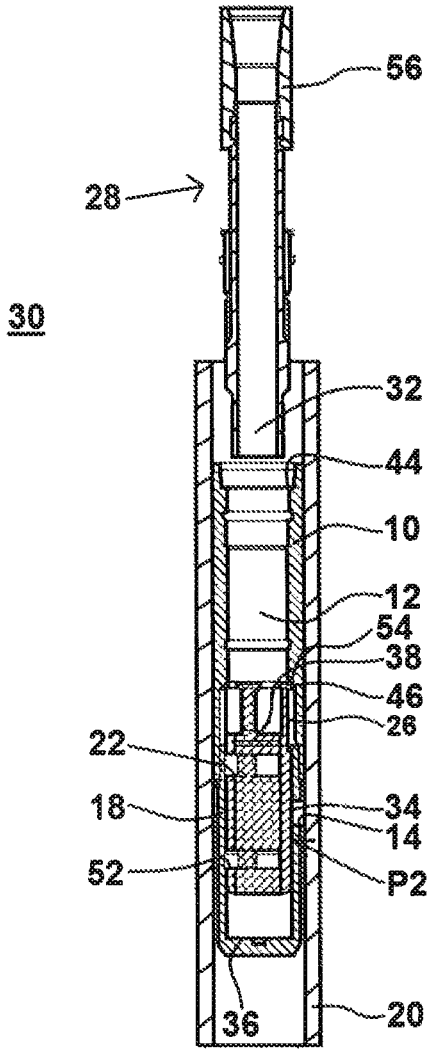
Figure 9:
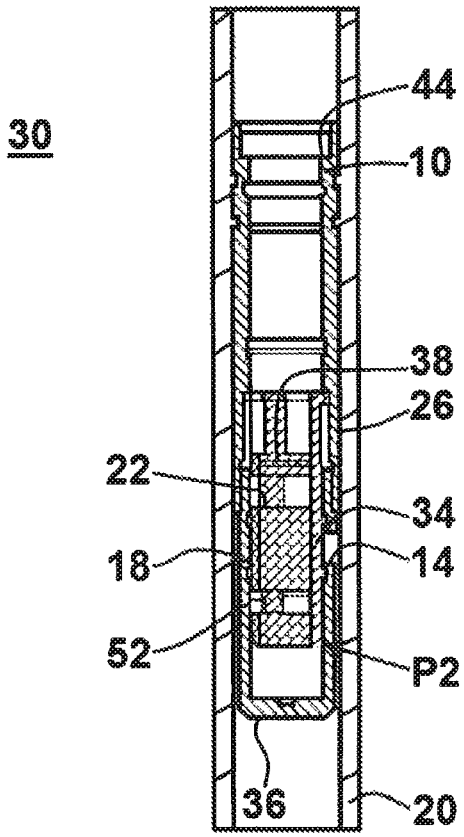
FIG. 9 illustrates the mechanical isolation device in the "closed" position according to an embodiment.

FIGS. 8 and 9 shows that stabbing tool 18 released from the attaching portion 26 and completely withdrawn from the receiver 18 and the sleeve 10, while the mechanical isolation device is in the "closed" position. The receiver 18 is held in the "closed" position of the mechanical isolation device via, for instance, the locking finger (or fingers) 46 of the receiver 18 may engage with a second recess (or recesses) 54 on an inner surface 50 of the sleeve 10, to hold the receiver 18 in in the second position P2 (the "closed" position) to prevent further movement of the receiver 18 in the first direction "a" or the second direction "b".

A method of controlling fluid flow inside a tubular 20 in a wellbore 30 is described below. The method is apparent from the embodiments shown in FIGS. 1-9, and may involve one or more of the aspects of one or more of the embodiments discussed herein. Generally, the method includes positioning the receiver 18 within the internal bore 12 of the sleeve 10 so that the second orifice 52 of the receiver 18 is either aligned or unaligned with the port 14 of the sleeve 10. The sleeve 10 (and accompanying receiver 18) is then inserted into the tubular 20. The tubular 20 is then attached to a casing string and inserted into the wellbore 30. If the second orifice 52 of the receiver 18 is aligned with the port 14 of the sleeve 10, the sleeve 10 and accompanying receiver 18 are in the "auto-fill" position. Subsequently, the stabbing tool 28 is attached to an inner-string, and is inserted into the tubular 20 and onto the receiver 18. The stabbing tool 28 engages with the attaching portion 26 of the receiver 18, and presses against the receiver 18 to move the receiver 18 relative to the sleeve 10. In an embodiment, the stabbing tool 28 presses against the receiver 18 with approximately 10,000 lbs. of weight greater than the casing string weight. This movement un-aligns the second orifice 52 of the receiver 18 from the port 14 of the sleeve 10 (or keeps the second orifice 52 un aligned with the port 14 in the alternative embodiment discussed above), and moves the receiver 18 to the first position P1 at which the first orifice 22 of the receiver 18 is aligned with the port 14 of the sleeve 10, so that the mechanical isolation device is in the "pumping" position. The method may then comprise pumping cement into the internal bore 12 of the sleeve 10 and through the first orifice 22, the port (or ports) 14 of the sleeve 10, into the inside of the tubular 20, and then out through the bottom of the casing string to fill the annulus adjacent the outer surface of the casing string.

The method may further include moving the stabbing tool 28 in a direction out of the tubular 20 to pull the receiver 18, via the attaching portion 26, with an opposite force to the second position P2 at which the first orifice 22 of the receiver 18 is un-aligned with the port (or ports) 14 of the sleeve 10. Un-aligning the first orifice 22 of the receiver 18 from the port 14 of the sleeve 10 aligns the wall 34 of the receiver 18 with the port 14 of the sleeve 10 to close the port 14, thus placing the mechanical isolation device in the "closed" position. In the "closed" position, the wall 34 blocks flow between the internal bore 12 of the sleeve 10 and the port (or ports) 14 of the sleeve 10. In the "closed" position, fluid is prohibited from flowing into the internal bore 12 of the sleeve 10, and cement is prohibited from flowing out through the port (or ports) 14 and into the internal bore of the tubular 20. Once the mechanical isolation device is in the "closed" position, the stabbing tool 28 may be withdrawn from the receiver 18 with approximately 10,000 lbs. of weight greater than the casing string weight.

Because the mechanical isolation device is installed and run in with the casing/liner string, the conventional processes associated with mechanically setting a packer/bridge plug cement retainer with drill pipe or wireline are eliminated. Further, because the stabbing tool 28 is run on the drill pipe as part of an inner-string with the liner installation equipment, an extra pipe trip to access and actuate a valve also is eliminated. Moreover, the mechanical isolation device, systems and methods discussed herein eliminate wiper/cleanout trips needed for proper installation of packer/bridge plug cement retainers, and allow for timely displacement of fluids with completion fluids. As the mechanical isolation device is actuated with a single trip of a stabbing tool 28 on an inner-string tool down the casing/liner, the multiple trips down the casing string to access and actuate a valve, as in conventional cementing jobs, can be avoided. The mechanical isolation device thus provides significant time (and cost) savings during cementing operations. Further, because the receiver 18 is installed in the sleeve 10 and inserted in the tubular 20 at the surface, there is no need for a drillable packer/bridge plug cement retainers which take multiple rig operations to properly install.

Additionally, after the cement pumping operation, cement below the mechanical isolation device is isolated from pressure and fluid above the valve. Downhole pressure control is thus provided both above and below the mechanical isolation device, allowing for positive and negative testing of the annulus and the liner/casing during installation without having to install a separate breech plug or cement retainer in another trip down the casing string.

Figure 10D:
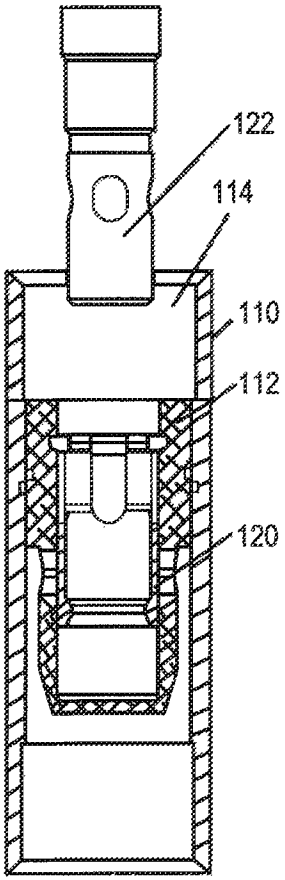
FIGS. 10*a*-10*d* depict a series of views of another embodiment of a mechanical isolation device.
Figure 10C:
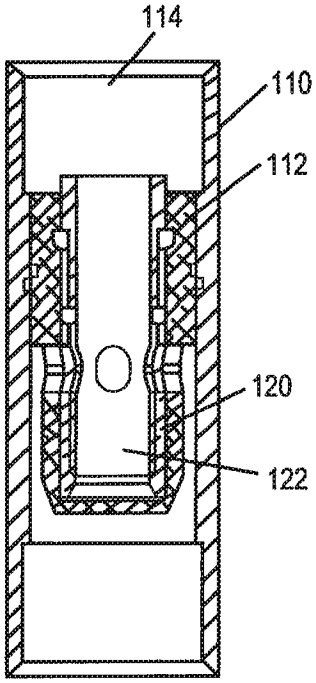
Figure 10B:
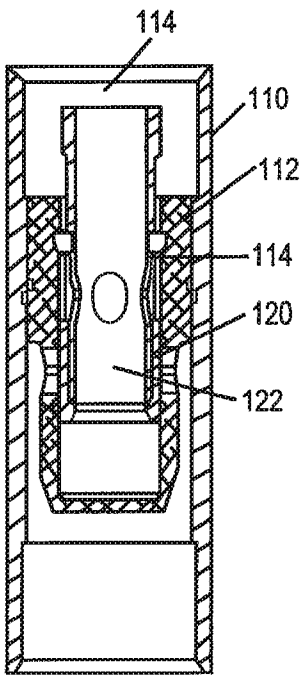
Figure 10A:
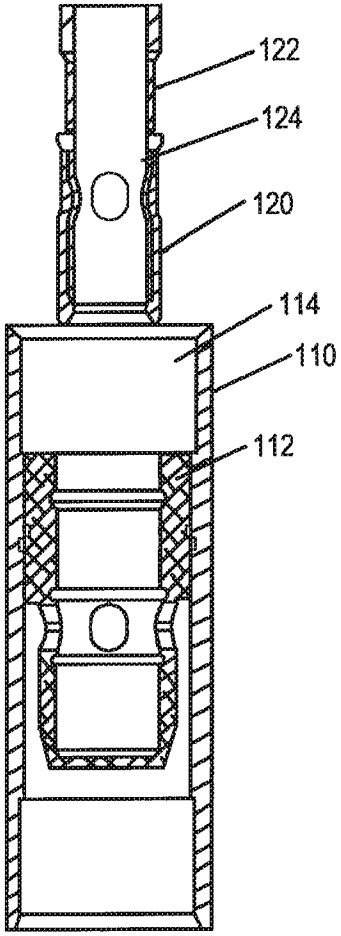

FIGS. 10A and 10B depict a view of the components of another embodiment of a mechanical isolation device. A coupling 110 forms a hollow joint between two segments of casing or tubulars. The coupling 110 acts as a float housing for a float valve receiver 112. The float valve receiver 112 can be inserted into the coupling 110 above-ground and prior to the casing operations. The float valve receiver 112 can be comprised of a drillable material, which may be selected from any suitable material known in the art (e.g., ductile metals, non-metallic composites).

Float valve receiver 112 can comprise an outer diameter 111 and an inner diameter 113. The outer diameter 111 can comprise two grooves 115 and 117, which may be sized to accept therein a seal 114 and a locking ring 116, respectively. The seal 114 and the locking ring 116 can compress upon the insertion of the float valve receiver 112, into the coupling 110, ensuring a fluid-tight fit. The inner diameter 113 of the float valve receiver 112 can comprise a number of tapers 118 intended to match the outer contours of a float valve 120.

The float valve 120 is lowered into the receiver on a stabbing tool 122, and then stabbed into place. FIG. 10A shows that the float valve receiver 112 is positioned within the coupling 110. Float valve receiver 112 may be connected to a box thread connection 114 within the coupling 110 facing up-hole. The float valve receiver 112 within casing coupling 110 is lowered downhole first.

Subsequently, the float valve 120 is mounted on the operating tube of the stabbing tool 122 via, for instance, a shear pin 124, and is lowered down the wellbore to meet the coupling 110. In FIG. 10B, the float valve 120 is shown in the "closed" position with the float valve 120 attached to the stabbing tool 122 and positioned through box thread connection 114. In an alternate embodiment, an expandable collet (not shown) may be used to attach the float valve 120 within the receiver 112 rather than utilizing a shear pin.

FIG. 10C shows that, in order to "open" the valve, the stabbing tool 122 is stabbed downward, shearing the shear pin 124 and aligning the float valve 120 with the float valve receiver 112. FIG. 10D shows the stabbing tool 122 being raised back through the wellbore with the float valve 120 remaining in place, within float valve receiver 112 and casing coupling 110.

While various embodiments usable within the scope of the present disclosure have been described with emphasis, it should be understood that within the scope of the appended claims, the present invention may be practiced other than as specifically described herein.

What is claimed is:

1. A system for controlling fluid flow inside a tubular in a wellbore, comprising:

a sleeve for positioning in the tubular, wherein the sleeve comprises an internal bore that is open at one axial end thereof and closed with a wall at an opposite axial end, and the sleeve comprises a port for fluid flow between the internal bore of the sleeve and an inside of the tubular;

a receiver positioned in the internal bore of the sleeve, wherein the tubular, sleeve and receiver form a unit for insertion into the wellbore, wherein the receiver comprises a first orifice and a second orifice spaced axially from the first orifice, each of the first orifice and the second orifice for fluid flow between the internal bore of the sleeve and the port of the sleeve, and wherein the first orifice is unaligned with the port of the sleeve and the second orifice is either aligned or unaligned with the port of the sleeve; and a tool that is axially lowered into the wellbore and the tubular, wherein the tool: (i) moves the receiver in a first direction to move the first orifice into alignment with the port of the sleeve and moves the second orifice out of alignment with the port of the sleeve or keeps the second orifice out of alignment with the port of the sleeve, and (ii) moves the receiver in a second direction to move the first orifice out of alignment with the port of the sleeve so that a portion of the receiver covers the port of the sleeve.

2. The system according to claim 1, wherein the alignment of the first orifice with the port of the sleeve opens a fluid flow path between the internal bore of the sleeve, the first orifice, the port of the sleeve, and the inside of the tubular, wherein the portion of the receiver covering the port blocks fluid flow between the internal bore of the sleeve and the port of the sleeve.

3. The system according to claim 1, wherein the first orifice comprises a set of two or more orifices located around a circumference of the receiver at a first axial location on the receiver, wherein the sleeve comprises two or more ports, and wherein each of the two or more orifices moves into alignment with one of the two or more ports via movement of the receiver in the first direction.

4. The system according to claim 1, wherein the tool comprises a distal end, and the receiver comprises an attaching portion that releasably engages the distal end of the tool when the tool is moved in the first direction onto to the receiver, and wherein the tool moves the receiver in the second direction via the attaching portion.

5. The system according to claim 4, wherein an inner diameter of the sleeve varies along a length of the sleeve in an area adjacent the attaching portion, so that movement of the attaching portion along the area increases or decreases an outer diameter of the attaching portion.

6. The system according to claim 5, wherein a decrease in the outer diameter of the attaching portion engages the attaching portion to the distal end of the tool, and wherein an increase in the outer diameter of the attaching portion disengages the attaching portion from the distal end of the tool.

7. The system according to claim 4, wherein the attaching portion comprises at least one locking finger that engages with a recess on an inner surface of the sleeve to position the receiver at a predetermined location inside of the sleeve.

8. The system according to claim 1, wherein the sleeve comprises a first no-go shoulder that engages with a portion of the receiver to prevent further movement of the receiver in the second direction when the first orifice is out of alignment with the port of the sleeve.

9. The system according to claim 8, wherein the sleeve comprises a second no-go shoulder that engages with a portion of the tool to prevent further movement of the tool in the first direction after the first orifice is moved into alignment with the port of the sleeve.

10. The system according to claim 1, wherein a longitudinal length of the receiver extends from one end of the receiver to an opposite end of the receiver, wherein the first orifice is at a first axial location on the longitudinal length, and wherein the second orifice is provided at a second axial location on the longitudinal length.

11. The system according to claim 10, wherein the second orifice is aligned with the port of the sleeve before the tool moves the receiver in the first direction to move the first orifice into alignment with the port of the sleeve, and wherein the alignment of the second orifice with the port forms a fluid flow path between the internal bore of the sleeve, the second orifice, the port of the sleeve, and the inside of the tubular.

12. A mechanical isolation device for controlling fluid flow inside a tubular in a wellbore, comprising:

a sleeve comprising an internal bore that is open at one axial end thereof and closed with a wall at an opposite axial end, and the sleeve comprises a port for fluid flow between the internal bore of the sleeve and an inside of the tubular; and a receiver positioned in the internal bore of the sleeve, wherein the receiver comprises an attaching portion at one end of the receiver, wherein a first orifice is at a first axial location on a longitudinal length of the receiver, wherein a second orifice is at a second axial location on the longitudinal length, and wherein the second orifice is either aligned or un-aligned with the port of the sleeve, and the receiver is slidable within the sleeve to:

(i) move the first orifice into alignment with the port of the sleeve and either move the second orifice out of alignment with the port of the sleeve or keep the second orifice out of alignment with the port of the sleeve, for fluid flow between the internal bore of the sleeve, the first orifice, and the port of the sleeve; and (ii) move the first orifice out of alignment with the port of the sleeve so that a portion of the receiver covers the port of the sleeve to block fluid flow between the internal bore of the sleeve and the port of the sleeve.

13. The mechanical isolation device according to claim 12, wherein the sleeve comprises a first no-go shoulder that engages with a portion of the receiver to prevent movement of the receiver beyond the no-go shoulder.

14. The mechanical isolation device according to claim 12, wherein an inner diameter of the sleeve varies along a length of the sleeve in an area adjacent the attaching portion, such that movement of the attaching portion along the area increases or decreases an outer diameter of the attaching portion.

15. The mechanical isolation device according to claim 14, wherein the attaching portion is configured to engage and disengage a distal end of a tool, wherein a decrease in the outer diameter of the attaching portion engages the attaching portion to the distal end of the tool, and wherein an increase in the outer diameter of the attaching portion disengages the attaching portion from the distal end of the tool.

16. The mechanical isolation device according to claim 12, wherein the attaching portion comprises at least one locking finger that engages with a recess on an inner surface of the sleeve when the receiver is in a position such that the portion of the receiver covers the port of the sleeve.

17. The mechanical isolation device according to claim 12, wherein the first orifice comprises a set of two or more first orifices located around a circumference of the receiver at the first axial location, wherein the second orifice comprises a set of two or more second orifices located around a circumference of the receiver at the second axial location, wherein the sleeve comprises two or more ports around a circumference of the sleeve at an axial location on the sleeve, wherein each of the two or more ports is alignable with one of the two or more first orifices, and wherein each of the two or more ports is alignable with one of the two or more second orifices.

18. A method of controlling fluid flow inside a tubular in a wellbore, comprising:

positioning a receiver within an internal bore of a sleeve, wherein a first orifice of the receiver is either aligned or un-aligned with a port of the sleeve;

inserting the sleeve inside of the tubular;

installing the tubular, comprising the sleeve and the receiver, with the non of the sleeve adjacent the tubular, in the wellbore;

inserting a tool axially into the tubular and onto the receiver to move the receiver with a force, wherein the force moves the receiver relative to the sleeve to align a second orifice of the receiver with the port of the sleeve, the second orifice being spaced axially from the first orifice, and the force either un-aligns or keeps un-aligned the first orifice of the receiver from the port of the sleeve; and pumping cement into the internal bore of the sleeve and through the second orifice, the port of the sleeve, and the inside of the tubular.

19. The method according to claim 18, further comprising:

moving the tool in a direction out of the tubular to move the receiver with another force that un-aligns the second orifice of the receiver from the port of the sleeve.

20. The method according to claim 19, wherein un-aligning the second orifice of the receiver from the port of the sleeve aligns a portion of the receiver with the port of the sleeve to close the port.

* * * * *